US007433610B2

(12) United States Patent
Oyama

(10) Patent No.: US 7,433,610 B2
(45) Date of Patent: Oct. 7, 2008

(54) IMAGE FORMING APPARATUS HAVING SHIELDED AREA IN WHICH NON-CONTACT WIRELESS COMMUNICATION OCCURS

(75) Inventor: Kiyoshi Oyama, Shinjuku-ku (JP)

(73) Assignee: Canon Kabushiki Kaisha (JP)

( * ) Notice: Subject to any disclaimer, the term of this patent is extended or adjusted under 35 U.S.C. 154(b) by 217 days.

(21) Appl. No.: 11/397,490

(22) Filed: Apr. 4, 2006

(65) Prior Publication Data

US 2006/0219770 A1 Oct. 5, 2006

(30) Foreign Application Priority Data

Apr. 5, 2005 (JP) ..... 2005-108397

(51) Int. Cl.
*G03G 15/20* (2006.01)
*G03G 15/00* (2006.01)

(52) U.S. Cl. ..... 399/25; 399/12

(58) Field of Classification Search ..... 399/12, 399/13, 24–26
See application file for complete search history.

(56) References Cited

U.S. PATENT DOCUMENTS

2005/0286914 A1* 12/2005 Nagahama ..... 399/12
2006/0140648 A1* 6/2006 Takegawa ..... 399/12

FOREIGN PATENT DOCUMENTS

JP 11-348375 A 12/1999
JP 11348375 A * 12/1999
JP 2000-246921 A 9/2000
JP 2001-022230 A 1/2001

* cited by examiner

*Primary Examiner*—Ryan Gleitz
(74) *Attorney, Agent, or Firm*—Rossi, Kimms & McDowell LLP

(57) ABSTRACT

An image forming apparatus has a plurality of detachably loadable replacement units. The replacement units each have an individual IC tag that performs data writing or reading through non-contact wireless communication. At least one reader/writer writes/reads data to/from the IC tags of the replacement units through non-contact wireless communications. A shield member defines a shielded area in the image forming apparatus for shielding electromagnetic radiation noise. At least the IC tags and an antenna part of the reader/writer are arranged in shielded area.

6 Claims, 19 Drawing Sheets

*FIG. 10*

| Addresses | Data 16bit |
|---|---|
| 0 ~ 1 | Serial NO |
| 2 | Counter |
| 3 | IP-OFFSET |
| 4 | PRIMARY |
| 5 ~ 63 | Empty ($FFFF_H$) |

*FIG. 11*

| Command | Start Bit | Operation Code | 64 words × 16 bits | |
|---|---|---|---|---|
| | | | Address | Data |
| READ (Data reading) | 1 | 10 | $A_5 \sim A_0$ | $D_{15} \sim D_0$ |
| WRITE (Data writing) | 1 | 01 | $A_5 \sim A_0$ | $D_{15} \sim D_0$ |
| WRAL (Chip writing) | 1 | 00 | 01xxxx | $D_{15} \sim D_0$ |
| ERASE (Data erasing) | 1 | 11 | $A_5 \sim A_0$ | — |
| ERAL (Chip erasing) | 1 | 00 | 10xxxx | — |
| EWEN (Program enable) | 1 | 00 | 11xxxx | — |
| EWDS (Program disable) | 1 | 00 | 00xxxx | — |

(A) Data reading-out mode (B) Data writing mode (C) Data erasing mode

IMAGE FORMING APPARATUS HAVING SHIELDED AREA IN WHICH NON-CONTACT WIRELESS COMMUNICATION OCCURS

BACKGROUND OF THE INVENTION

1. Field of the Invention

The present invention relates to an image forming apparatus to which a replaceable replacement unit is detachably loaded.

2. Description of the Related Art

Some conventional image forming apparatuses facilitate maintenance by a user, by making consumables such as a photosensitive drum or toner a replaceable unit to the main body of the image forming apparatus. In addition, recently, with the objective of improving image quality or accurately controlling service life of a replacement unit, replacement units having a memory element to/from which such information can be written/read have emerged. The writing/reading of data to/from the memory element mounted in the replacement unit is usually performed with it connected to the main body of the image forming apparatus through a connector. However, such a configuration suffers from the problem that signals to the memory element are weak and even a venial loose connection causes a malfunction.

Hence, as a memory element to be mounted in said replacement unit, a wireless IC tag has been proposed so that writing/reading of data can be performed in non-contact manner.

In Japanese Patent Application Laid-Open (JP-A) No. 2000-246921 publication (hereinafter referred to as Patent Document 1), an IC chip having stored therein information such as data on identification with an image forming apparatus, ink level, etc. is loaded in a replaceable ink cartridge. Then, an image forming apparatus to which said cartridge can be detachably loaded comprises a reader/writer associated with said IC chip. The configuration and the technologies disclosed in the Patent Document 1 could enable the image forming apparatus itself and said IC chip to communicate said information in non-contact manner, with the cartridge loaded onto the image forming apparatus.

In addition, in JP-A No. 2001-22230 publication (hereinafter referred to as Patent Document 2), non-contact communication IC tags are respectively mounted in a plurality of replaceable cartridges. It also discloses the configuration in which one reader/writer capable of transmitting/receiving information to/from the respective said IC tags in non-contact manner is provided on the main body of the image forming apparatus to which said cartridges are detachably loaded.

In the technology described the Patent Documents mentioned above, however, since communication with an IC tag mounted in a replacement unit takes place in non-contact manner, electromagnetic radiation noise may possibly leak to the outside of the apparatus during communication thereof. In addition, according to the international standard, intensity of the electromagnetic radiation noise leaking from the apparatus must be reduced below a certain limit.

In the technology disclosed in Patent Document 2, in particular, non-contact communication IC tags that are separately mounted in a plurality of replacement units are deployed in a relatively wide range, wherein one reader/writer is responsible for communication with these IC tags. In other words, as communication distance between the said respective IC tags deployed in a relatively wide range and the one reader/writer increases, output level of radio wave necessary for transmission/reception of information should be set higher. Thus, there is fear that leakage of the electromagnetic radiation noise described above will relatively increase.

SUMMARY OF THE INVENTION

Therefore, it is an object of this invention to substantially reduce leakage of electromagnetic radiation noise when IC tags respectively mounted in a plurality of replacement units are communicated by one reader/writer.

A typical configuration of the present invention to achieve said object is an image forming apparatus to which a plurality of replacement units are detachably loaded, wherein the replacement units have individual IC tags capable of writing or reading data through non-contact wireless communication, the image forming apparatus having at least one reader/writer that writes/reads data from/to the IC tags of said replacement units through non-contact wireless communication, characterized in that within said image forming apparatus a blocked area shielded by a shield member for shielding electromagnetic radiation noise is formed, and the IC tags that at least an antenna part and said replacement units of said reader/writer have are deployed in said blocked area.

According to the present invention described above, it is possible to substantially reduce leakage of electromagnetic radiation noise when IC tags mounted respectively in a plurality of replacement units are communicated by at least one reader/writer.

BRIEF DESCRIPTION OF THE DRAWINGS

FIG. 10 is an illustration showing data stored in the memory of the RFID tag.

FIG. 11 is an illustration showing operation codes of the memory of the RFID tag.

DESCRIPTION OF THE EMBODIMENTS

In the following, with reference to the figures, a preferred embodiment of the present invention is illustrated in details.

First Embodiment

Figure 2:
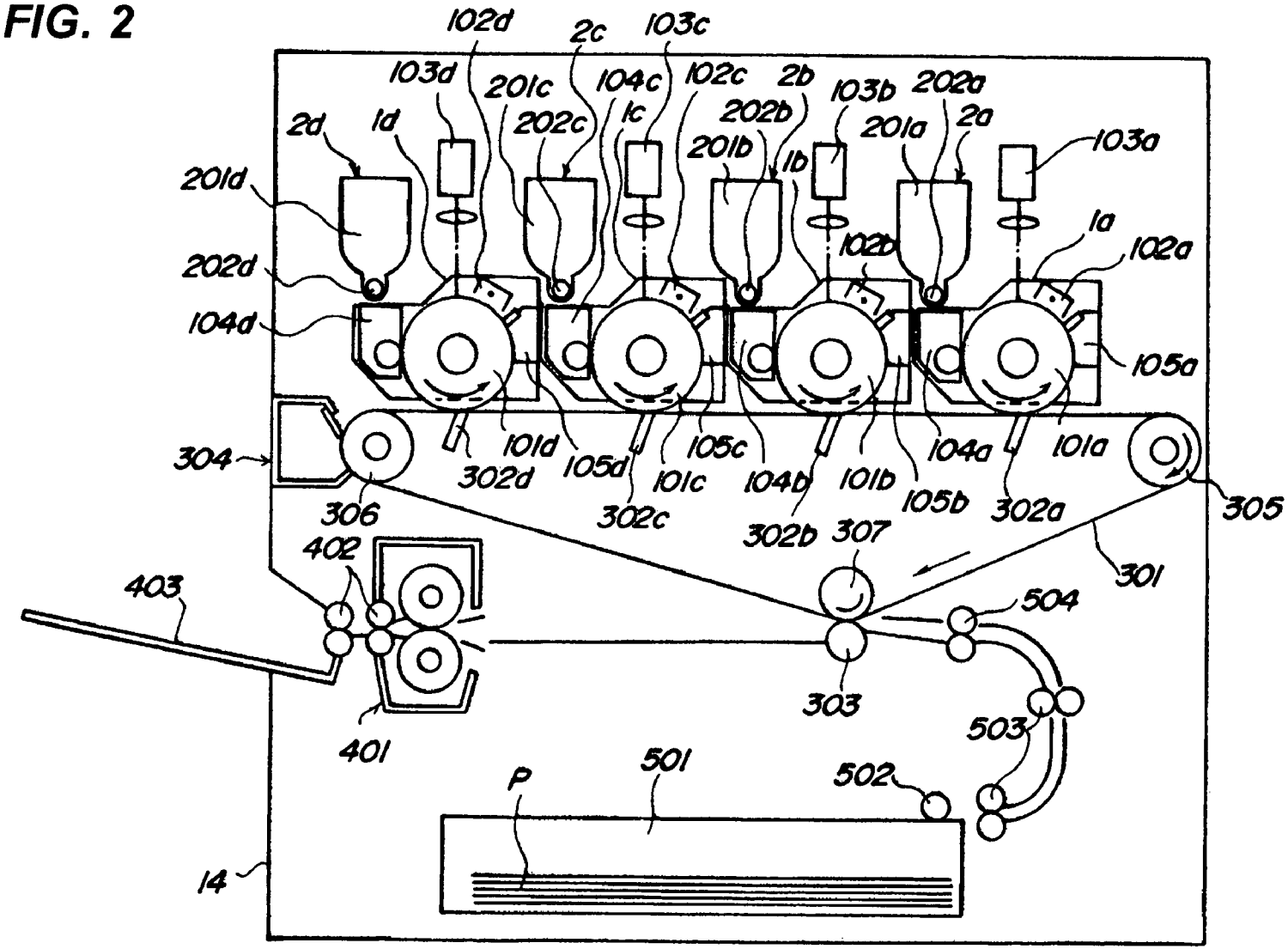
FIG. 2 is a schematic sectional view of an electrophotographic color printer as an example of an image forming apparatus.

An image forming apparatus according to a first embodiment of the present invention based on the drawings will be described. FIG. 2 is a schematic sectional view of an electrographic color printer by way of an example of the image forming apparatus.

An electrographic color printer as shown in FIG. 2 comprises process cartridges 1 (1*a*, 1*b*, 1*c*, 1*d*) each of which can be independently and detachably loaded in the main body and toner cartridges 2 (2*a*, 2*b*, 2*c*, 2*d*) that use a container of developer as a cartridge.

Around photosensitive drums 101 (101*a*, 101*b*, 101*c*, 101*d*) as an image bearing member, are arranged charging devices 102 (102*a*, 102*b*, 102*c*, 102*d*) that uniformly charge surfaces of the photosensitive drums 110, charging devices 102 (102*a*, 102*b*, 102*c*, 102*d*) that uniformly charges surfaces of the photosensitive drums 101, exposure devices 103 (103*a*, 103*b*, 103*c*, 103*d*) that expose image information onto the photosensitive drums 101, development apparatuses 104 (104*a*, 104*b*, 104*c*, 104*d*) that manifest electrostatic latent images on the photosensitive drums 101, primary transfer charging devices 302 (302*a*, 302*b*, 302*c*, 302*d*) that transfer toner images on the photosensitive drums 101 onto an intermediate transfer member 301, and cleaning devices 105 (105*a*, 105*b*, 105*c*, 105*d*) that collect toner remaining on the photosensitive drums 101.

There are also arranged a secondary transfer device 303 that transfers onto recording materials P such as sheets, etc., the toner images transferred to the intermediate transfer member 301, an intermediate transfer cleaning device 304 that collects toner remaining on the intermediate transfer member 301, a fixing device 401 that fixes unfixed toner images onto the recording materials P, a discharge roller 402 that discharges the recording materials P that has been settled, and a discharge tray 403 on which the recording materials P after being discharged is stacked. The intermediate transfer member 301 is an endless belt of a dielectric film being put around a driving roller 305, a driven roller 306, and a secondary transfer opposed roller 307, wherein the belt part being stretched between the driving roller 305 and the driven roller 306 contacts the photosensitive drums 101*a*, 101*b*, 101*c*, 101*d*, and goes around in the arrow direction when it is driven.

Toner containers 201 (201*a*, 201*b*, 201*c*, 201*d*) in the toner cartridges 2 contain toner, and rotate toner filling screws 202 (202*a*, 202*b*, 202*c*, 202*d*) to refill toner, when a toner amount detection device (not shown) of development means send a toner refill signal.

Said recording materials P are loaded in a sheet cassette 501, and serially fed sheet by sheet by a feed roller 502. Furthermore, said recording materials P are conveyed by a conveyance roller 503 and sent out by a registration roller 504 in synchronization with the toner images on the photosensitive drums 101. In addition, although the sheet cassette 501 shown in FIG. 2 exemplifies the case in which it is configured as a single stage, the configuration may also be possible wherein more than one stage is placed so that they can contain recording materials of a different size of or a different loaded orientation, and thus desired recording materials can be selected.

The entire image forming process in the electrophotographic color printer having the configuration as described above is similar to the known procedure and thus omitted herein.

Process cartridges 1*a*, 1*b*, 1*c*, 1*d*, integrally comprise said photosensitive drums 101*a*, 101*b*, 101*c*, 101*d*, respectively, and the charging devices 102*a*, 102*b*, 102*c*, 102*d*, the development apparatuses 104*a*, 104*b*, 104*c*, 104*d*, the cleaning devices 105*a*, 105*b*, 105*c*, 105*d*, as a process means functioning on the photosensitive drums. The toner cartridges 2*a*, 2*b*, 2*c*, 2*d* integrally comprise the toner containers 201*a*, 201*b*, 201*c*, 201*d* and the toner refill screws 202*a*, 202*b*, 202*c*, 202*d*, respectively.

Figure 3:
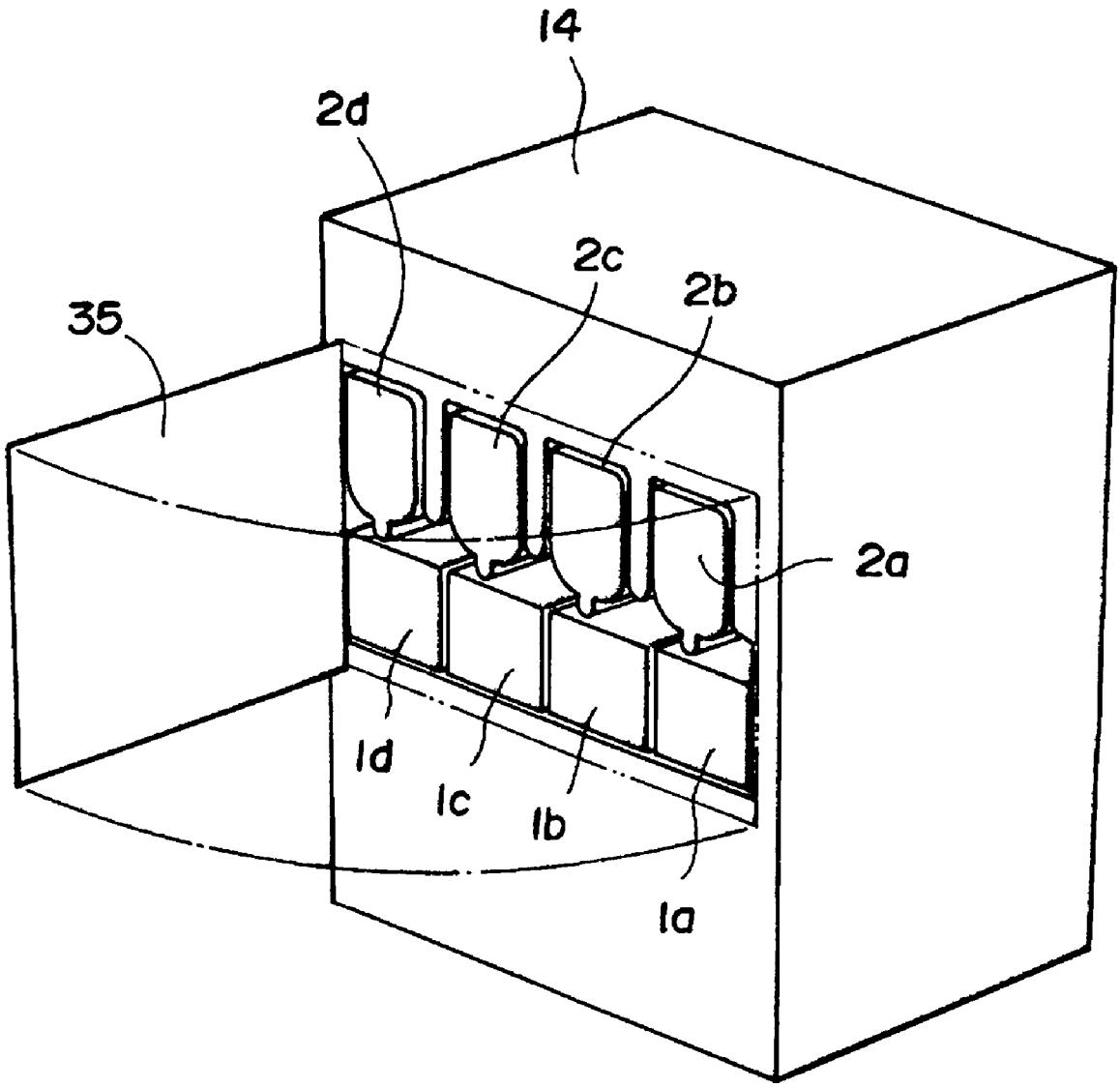
FIG. 3 is a schematic perspective view showing the condition in which an openable/closable cover on the front side of an electrophotographic color printer is opened.
Figure 4:
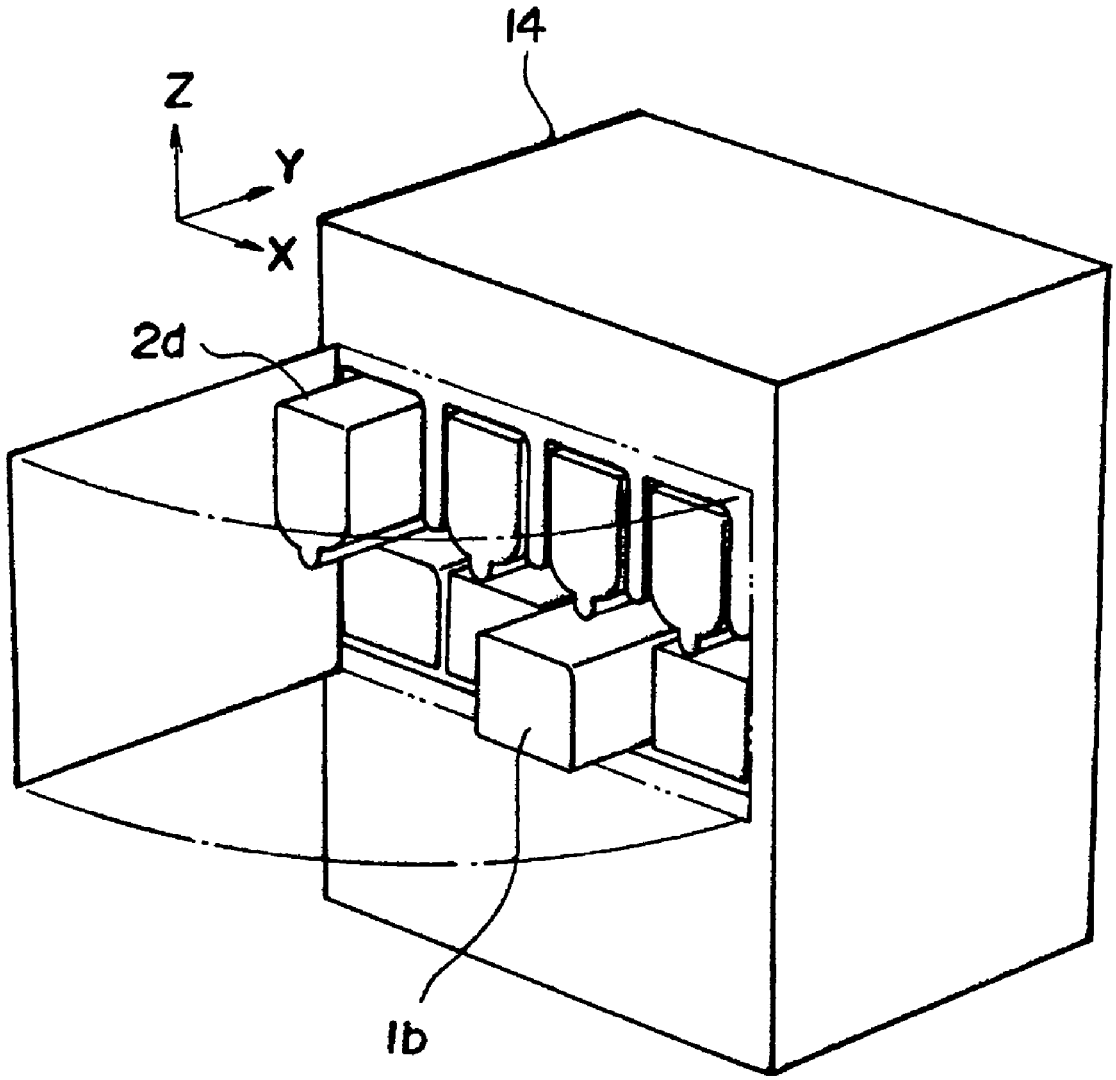
FIG. 4 is a schematic perspective view showing a cartridge of an electrographic color printer in the process of being attached/detached.

FIG. 3 and FIG. 4 are schematic perspective views of an electrophotographic color printer. FIG. 3 shows an openable/closable cover 35 on the front side of the apparatus main body 14 in opened state. FIG. 4 exemplifies the process cartridge 1*b* and the toner cartridge 2*d* being halfway attached/detached. FIG. 4 exemplifies the state where the process cartridge 1*b* and the toner cartridge 2*d* being drawn out halfway. The cover 35 can be opened/closed to the apparatus main body 14, and is a cover member covering the process cartridges 1 and the toner cartridges 2 loaded into the apparatus main body 14 as replacement units. The process cartridges 1*a*, 1*b*, 1*c*, 1*d* and the toner cartridges 2*a*, 2*b*, 2*c*, 2*d* are detachably loaded in the Y direction by guide rails (not shown) of the electrophotographic color printer main body 14. Then, the photosensitive drums 101 are in parallel to the Y direction.

Figure 5:
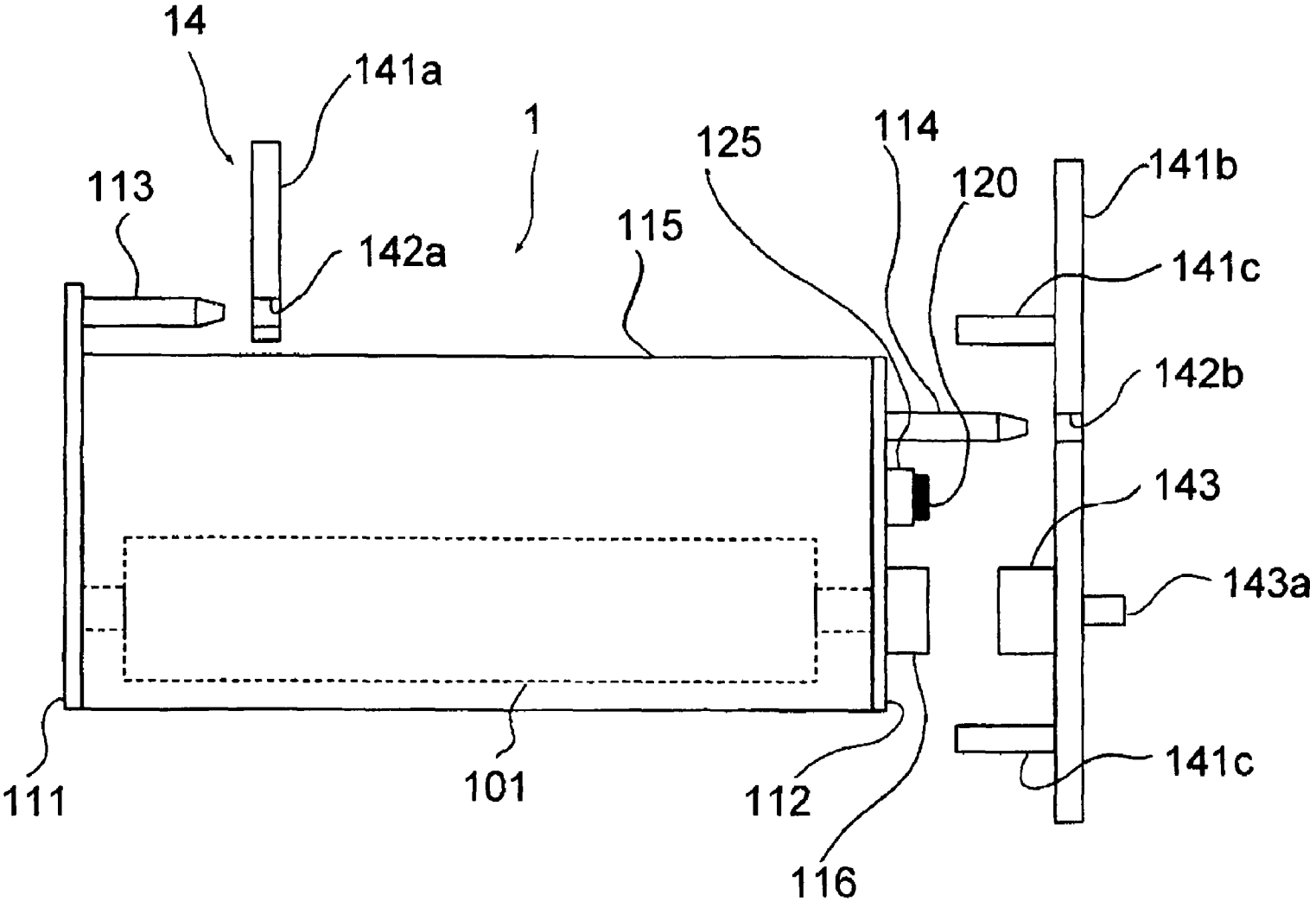
FIG. 5 is a side sectional view of the process cartridge according to the first embodiment that is being inserted partway into a printer main body.
Figure 6:
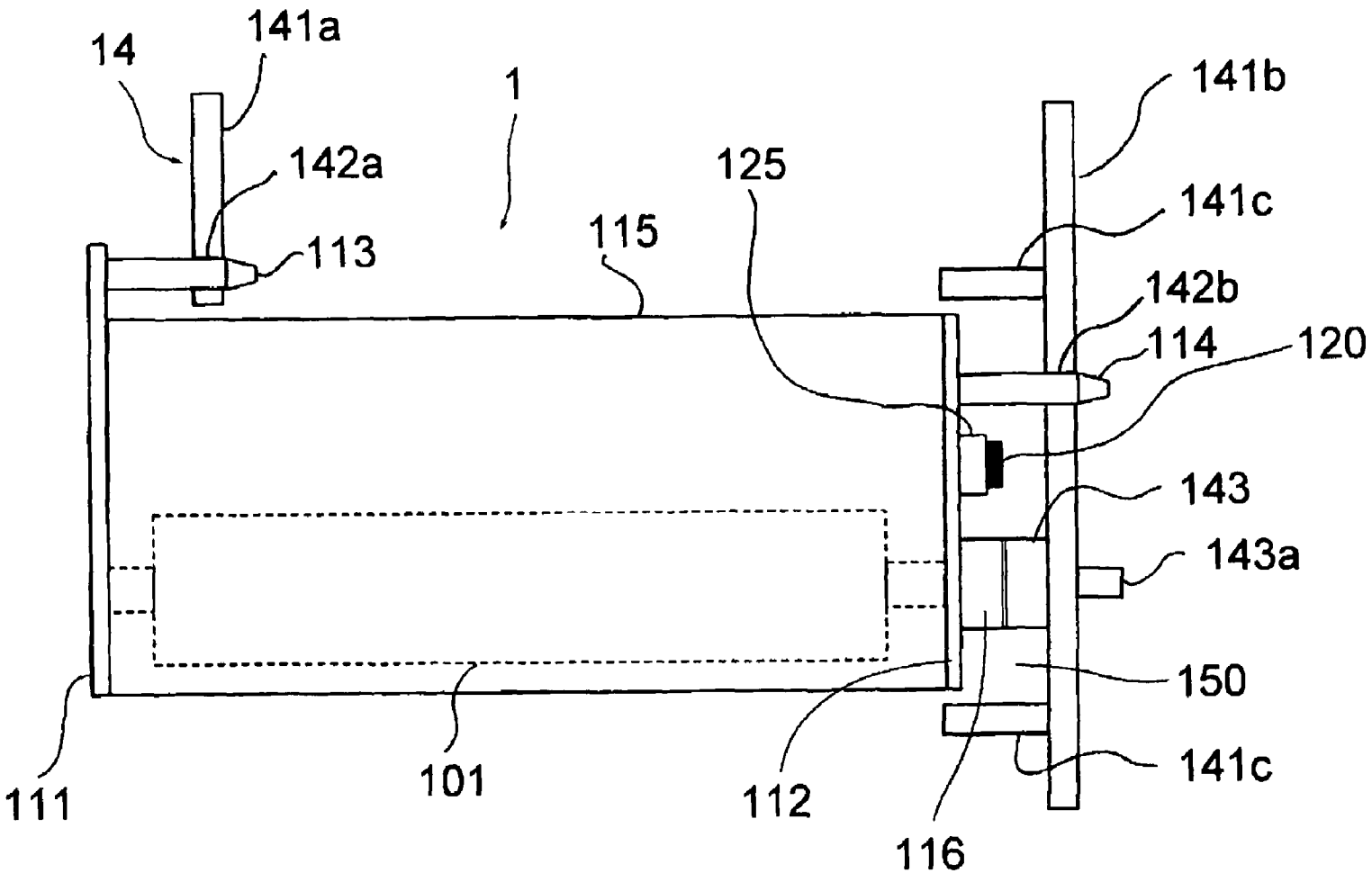
FIG. 6 is a side sectional view of the process cartridge according to the first embodiment that is completely loaded onto the printer main body.

FIG. 5 and FIG. 6 are side sectional views of the process cartridge and the apparatus main body 14 in attached/detached condition, when viewed in the X direction in FIG. 4. FIG. 5 shows the process cartridge being inserted partway into the apparatus main body 14, and FIG. 6 shows the process cartridge 1 completely loaded into the apparatus main body 14.

The process cartridge 1 has the photosensitive drum 101 that is a component thereof, metal unit front side plate 111 and unit back side plate 112 that support the photosensitive drum 101 at the both ends, the charging device 102, the development apparatus 103, and cleaning device 104 (See FIG. 2), and a resin container 115 defining side walls that defines a middle part thereof.

Here, the configuration for positioning the process cartridge 1 with respect to the apparatus main body 14 will be described. The apparatus main body 14 has a metal main body front side plate 141*a* and a main body back side plate 141*b* for configuring a housing that supports a replacement unit such as the process cartridge 1, etc. The respective main body side plates 141*a*, 141*b* of the apparatus main body 14 are provided with positioning holes 142*a*, 142*b*, respectively, for positioning the process cartridges 1. On the one hand, the respective unit side plates 111, 112 of the process cartridge 1 are provided with positioning pins 113, 114 as positioning projections that fit into the positioning holes 142*a*, 142*b* of said respective main body side plates 141*a*, 141*b*, respectively.

As shown in FIG. 5, when the process cartridge 1 is loaded into the apparatus main body 14, the positioning holes 142*a*, 142*b* on the side of the main body fit in the positioning pins 113, 114 on the side of the unit, respectively, and thus the process cartridge 1 is positioned with respect to the apparatus main body 14.

The process cartridge 1 has a coupling 116 for transmitting a driving force to the photosensitive drum 101 and the development apparatus 104 (See FIG. 2). With the process cartridge 1 loaded into the apparatus main body 14, the coupling 116 will connect to a coupling 143 on the opposed side of the apparatus main body 14. A drive source is connected to the end 143*a* of the coupling 143 on the side of the apparatus main body 14. With this, drive is transmitted from the drive source on the side of the apparatus main body, the photosensitive drum 101 and the development apparatus 104 (See FIG. 2) of the process cartridge 1 are rotary driven, and the image forming process takes place.

In addition, the container 115 of the process cartridge 1 is provided with a base 125 that projects more backward than the unit side plate 112. An RFID tag 120, as an IC tag, whereby data writing or reading is performed through non-contact wireless communication is arranged on the base 125. RFID of an RFID tag, as used herein, stands for Radio Frequency Identification, and refers to the non-contact automatic recognition technology using electric wave.

Said RFID tag 12 as the IC tag, when any metal member is in the proximity, may not have a magnetic field formed correctly and thus can no longer communicate. Hence, in the present embodiment, as described above, the RFID tag 120 is placed on the insulating resin base 125, being separated from the metallic back side plate 112, thus avoiding the problems described above.

Figure 8:
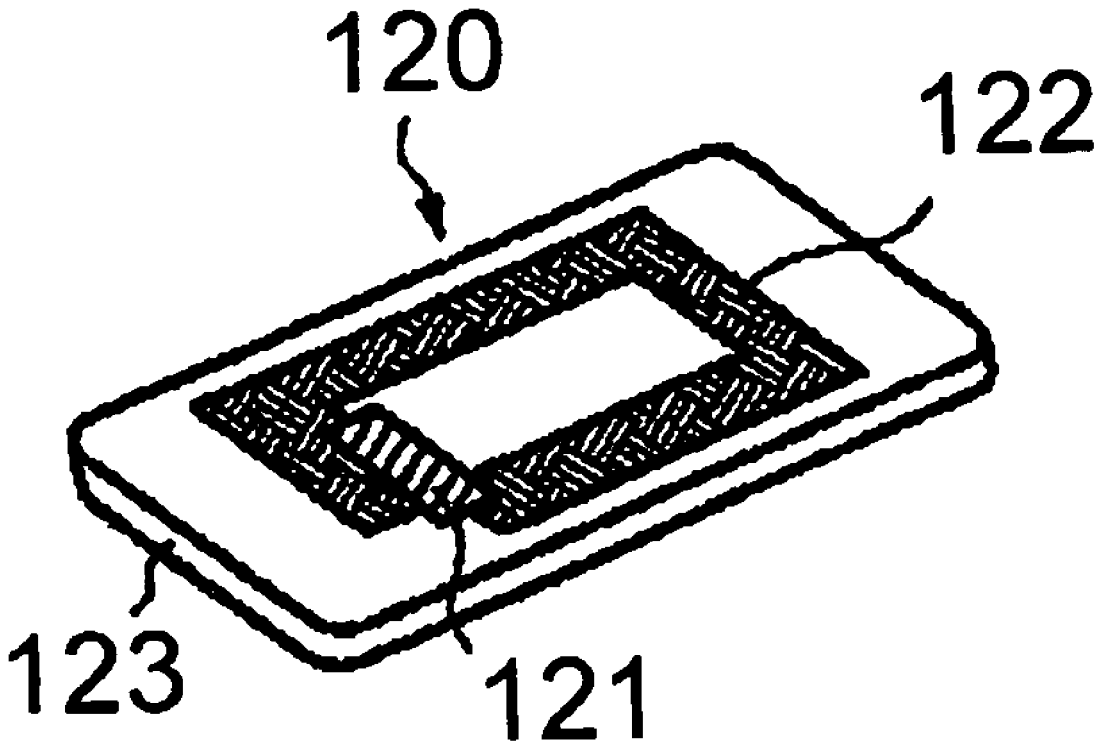
FIG. 8 is a perspective view of one example of the RFID tag.

The RFID tag 120, as shown in FIG. 8, is formed like a plate by a flexible circuit board 123 that is a thin circuit board forming an antenna pattern 122 by mounting a memory 121 where data reading and writing are performed.

In addition, said RFID tag 120 is of a non-battery type and is electromagnetically coupled from the antenna pattern 122 of the RFID tag 120 through a coil like antenna 145*a* with which the non-contact reader/writer 145 is provided on the side of the apparatus main body. This enables data write and read through non-contact wireless communication.

The memory 121 of the RFID tag 120 has necessary information (for instance, characteristic differences due to manufacturing fluctuations of the photosensitive drum or other process means) stored therein in advance, and is used for determining the state or the condition of usage of the process cartridge 1, etc., by electromagnetically coupling with the apparatus main body and exchanging information while the process cartridge 1 is being used.

Figure 1:
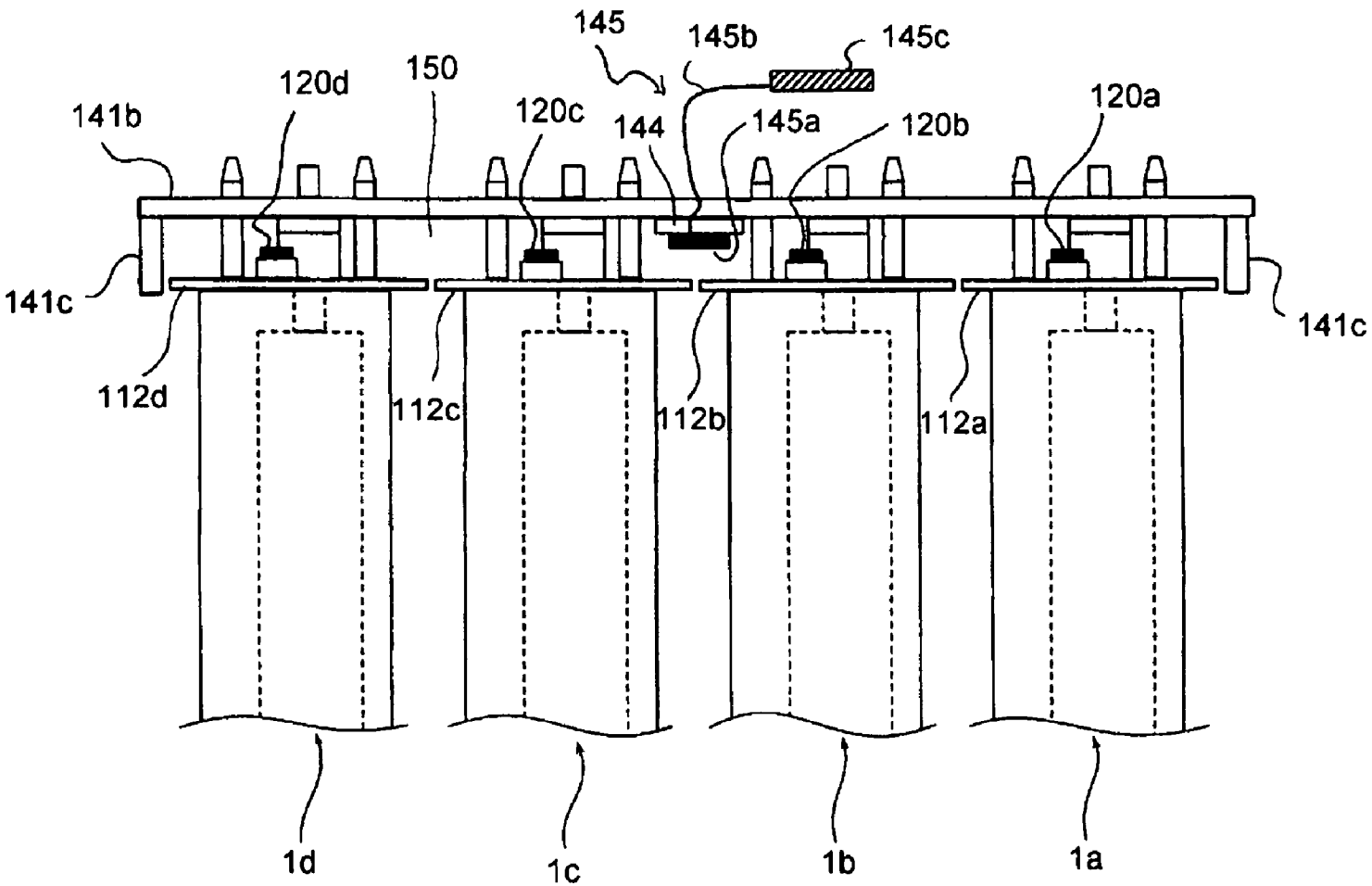
FIG. 1 is a schematic top sectional view showing a plurality of process cartridges according to a first embodiment loaded onto a printer main body.

FIG. 1 is a schematic top sectional view of the plurality of process cartridges 1*a*, 1*b*, 1*c*, and 1*d* loaded into the apparatus main body 14, when viewed from the Z direction in FIG. 4.

On the main body back side plate 141*b* is provided the resin base 144, and on the base 144 is arranged an antenna part 145*a* of a reader/writer 145 for electromagnetically coupling the RFID tag 120 and the apparatus main body 14. In addition, the reader/writer main body 145*c* is arranged in the proximity of the main body back side plate 145 and connected with the antenna part 145*a* by a wire harness 145*b*. In addition, the reader/writer 145 may be integrated with the antenna part 145*a*, and arranged on the resin base 144 that is provided on the main body back side plate 141*b* (the position of the antenna part 145*a* shown in FIG. 1).

As shown in FIG. 1, FIG. 5, and FIG. 6, the main body back side plate 141*b* has the side walls 141*c* formed so that the RFID tags 120*a*, 120*b*, 120*c*, 120*d* that intermediate between the main body side plate 141*b* and the unit side plates 112*a*, 112*b*, 112*c*, 112*d* of the respective process cartridges, and the antenna part 145*a* of the reader/writer 145 are surrounded on all four sides. Then, when the respective process cartridges 1*a*, 1*b*, 1*c*, 1*d* are loaded into the apparatus main body 14, any gap to be generated between the mutually neighboring parts of the unit back side plates 112*a*, 112*b*, 112*c*, 112*d* of the process cartridges 1*a*, 1*b*, 1*c*, 1*d*, and the side walls 141*c* of said respective unit side plates and said main body back side plate 141*b* will be minimal.

Thus, a substantially closed shielded area 150 is defined between the main body back side plate 141*b* of the apparatus main body 14 and the unit back side plates 112 of the respective process cartridges 1.

Said shielded area 150 is defined by loading the process cartridges 1 to the apparatus main body 14. Then, as the process cartridges 1 are loaded into the apparatus main body 14, RFID tags 120*a*, 120*b*, 120*c*, 120*d* of the respective process cartridges and the antenna part 145*a* of the reader/writer 145 are arranged within said shielded area 150.

In addition, as the unit back side plates 112 and the main body back side plate 141*b* that define said shielded area 150 are made of metal and sufficiently grounded, the area functions as a shield member for shielding electromagnetic radiation noise.

Thus, according to the present embodiment, communication between the RFID tag 120 and the antenna part 145*a* of the reader/writer 145 take place within the shielded area 150 consisted of the unit back side plates 112 that function as the shield member and the main body back side plate 141*b*. This can shield electromagnetic radiation noise that occurs during communication by the shield effect, thereby substantially reducing electromagnetic radiation noise leaking to the outside of the apparatus main body.

To be specific, as described above, even in the shield area configuration with a minimal gap generated between the unit back side plate 112 and the main body back side plate 141*b*, sufficient noise attenuation effect can be achieved if RFID tags 120 in low frequency band whose communication frequency is about 100 KHz is used.

Figure 7:
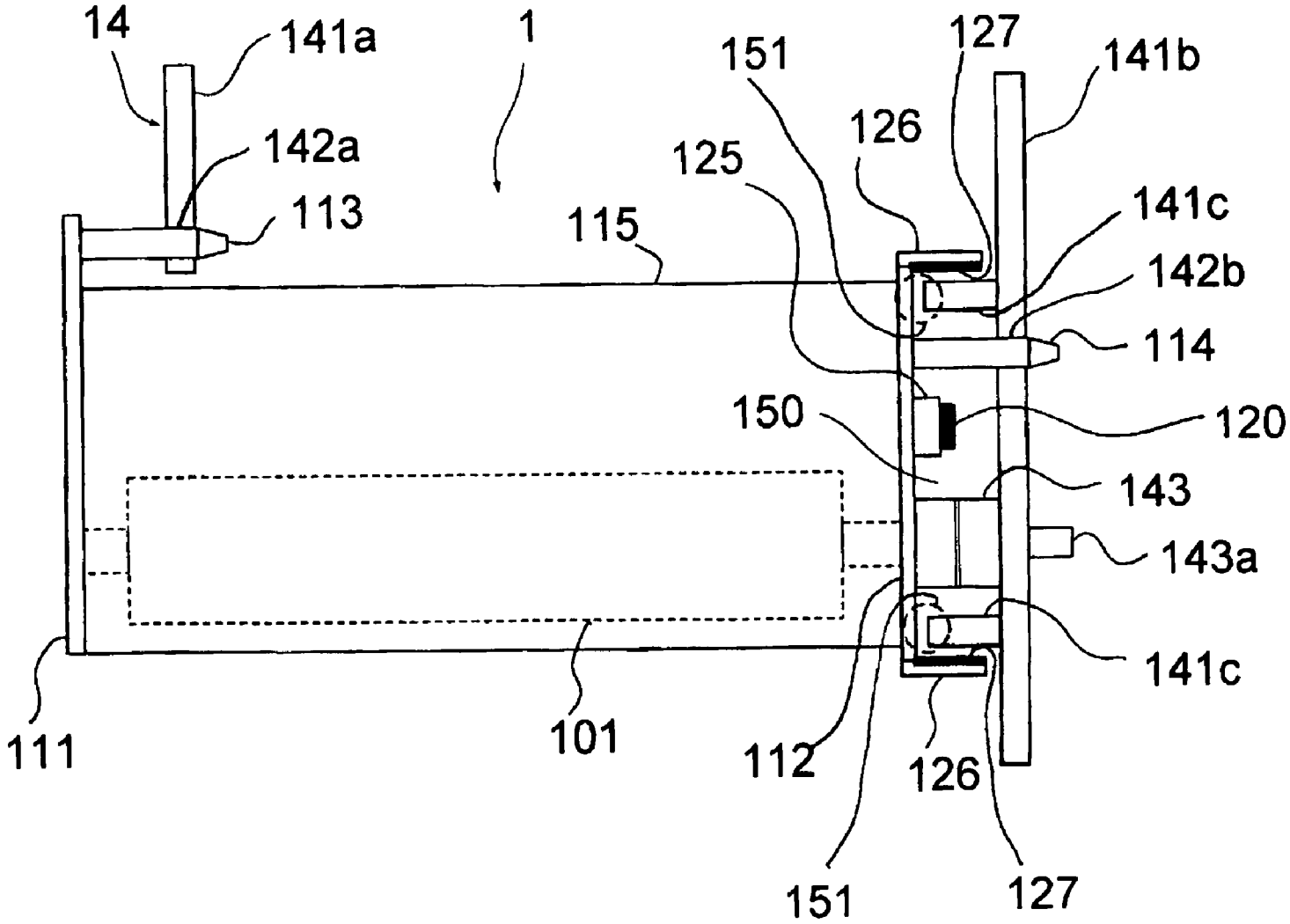
FIG. 7 is a side sectional view showing the process cartridge according to the first embodiment completely loaded into the printer main body.

In addition, in order to attain sufficient noise attenuation effect even if RFID tags in high frequency band whose communication frequency exceeds 10 MHz are used, the configuration would be preferably made wherein the gap in the shielded area as described above is covered by the shield member. Here, the specific configuration thereof will be described and exemplified by using FIG. 7. FIG. 7 is a schematic sectional view exemplifying other embodiments of the shielded area configuration as mentioned above.

As a shield plate (shield member) covering the minimal gap 151 generated between the unit back side plate 112 and the side walls 141*c* of the main body back side plate 141*b*, side walls 126 are formed for the unit side plates 112. Furthermore, the configuration is such that a common ground can be placed by bringing the unit side plate 112 into contact with the main body side plate 141*b* by a conductive spring member (not shown). With the configuration, adequate noise attenuation effect can be achieved in a high frequency band whose communication frequency exceeds 10 MHz and in the frequency bands of 500 MHz or lower.

In addition, in order to achieve the adequate nose attenuation effect in a high frequency band whose communication frequency exceeds 500 MHz, it is preferable to provide a radio wave absorption layer 127 on the inner surface side of the unit side plate 112 as said shielding plate, as shown in FIG. 7. As the radio wave absorption layer 127, a sheet like main body using organic binder into which ferrite or hexagonal ferrite particulates are mixed is used, and secured to the side walls 126 of the unit side walls 112 by adhesive tape. Such the configuration could achieve the adequate noise attenuation effect even in a high frequency band whose communication frequency exceeds 500 MHz.

In the present embodiment, although the configuration in which RFID tags 120 as IC tags mounted in process cartridges is exemplified and described as replacement units, the invention shall not be limited to the configuration. For instance, even in the configuration, for example, in which RFID tags 120 as IC tags are mounted in toner cartridges 2 as replacement units, or the configuration in which IRFID tags as IC tags are mounted in a replacement unit that is detachably loaded into other apparatus main body, application of this invention could achieve similar effect.

In addition, in the present embodiment, although the unit back side plates 112 and the main body back side plate 141*b* that are made of metal are used, as a shield member, even when these members are insulating, the members may be said shield member if a metal sheet member is attached to its surface.

Figure 9:
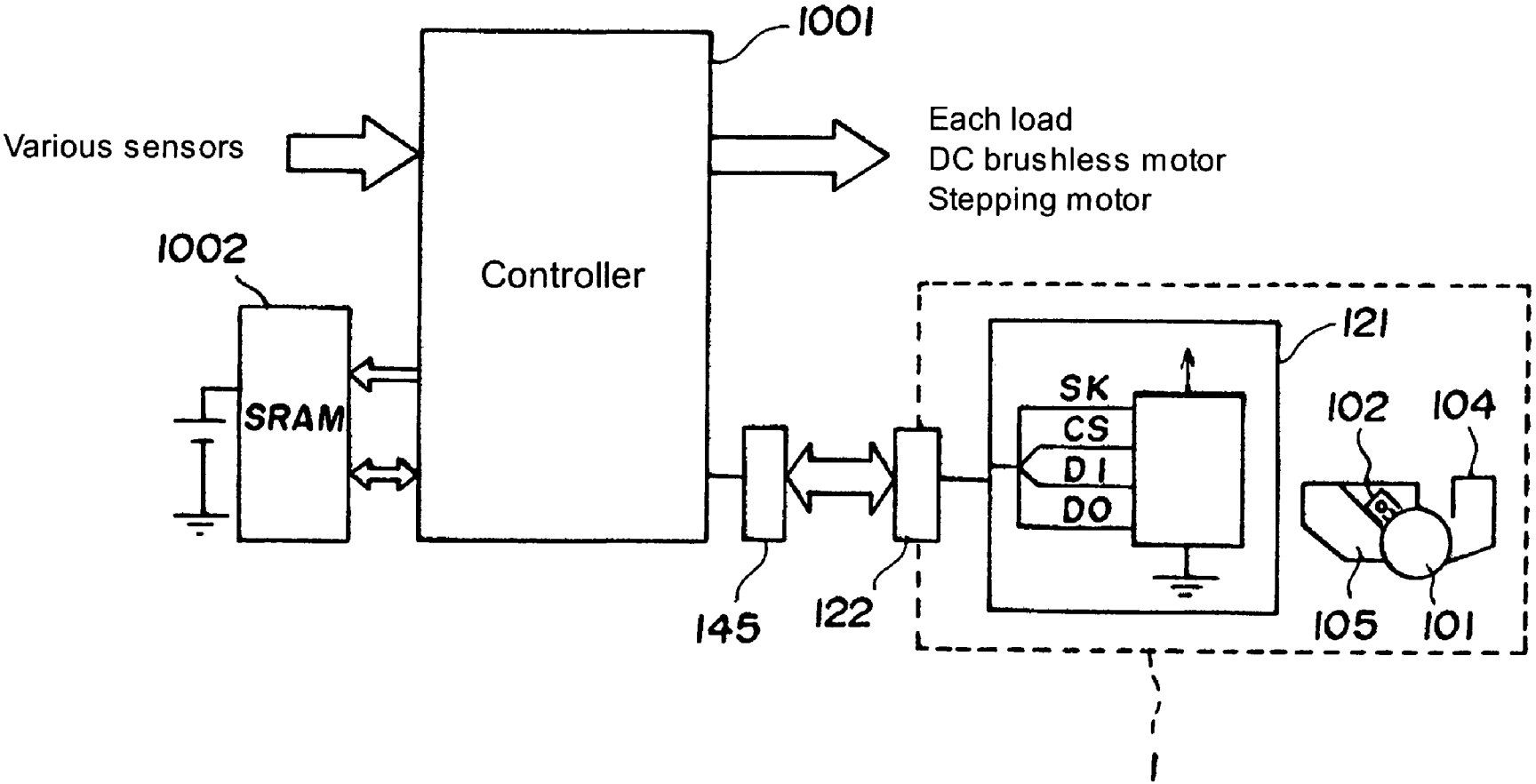
FIG. 9 is a block diagram showing the configuration of the controller of the image forming apparatus.

FIG. 9 is a block diagram showing the configuration of a controller of the image forming apparatus. In FIG. 9, the numeral 1001 designates a controller for controlling input from various sensors provided in the image forming apparatus, and output of each load to be driven to form images, such as a DC brushless motor, stepping motor, etc., and 1002 is SRAM that stores process conditions necessary for image formation, recovery information when jamming occurs, backup for the occurrence of error, etc. The numeral 121 designates a nonvolatile memory (EEPROM) as the antenna pattern of the RFID tag 120, 122 is an antenna pattern of the RFID tag 120 and is mounted in the respective process cartridges 1 (including the photosensitive drums 101, the charging devices 102, the development apparatus 104, and the cleaning devices 105) as RFID tags.

After the process cartridge 1 is loaded into the apparatus main body 14 and the RFID tags 120 and the reader/writer 145 are arranged within the shielded area 150 by the shielding member (See FIG. 1), the RFID tag 120 and the reader/writer 145 will be in an electromagnetic coupled state in non-contact manner.

FIG. 10 is an illustration showing data stored in the nonvolatile memory 121 of the RFID tags 120. As shown in FIG. 10, 16-bit data can be stored in one address. In FIG. 10, a serial number (00XXXXXXH) is stored in address 0 to 1, a counter value (XXXXH) in address 2, process condition 1 (XXXXH) in address 3, process condition 2 (XXXXH) in address 4, and empty (FFFFH) in addresses 5 to 63, as data.

Here, the process conditions 1, 2 are used to change the high voltage application condition when images are formed, depending on fluctuations in the photosensitive drums 101 of the process cartridge 1. The serial number is a number assigned to each of the process cartridges 1, and has two words (4 bytes) of information. The highest byte must be "00". In addition, "FFFFH" is placed in the empty address 5 to 63. The counter value increments the value only by "1" whenever a print is made.

Figure 12:
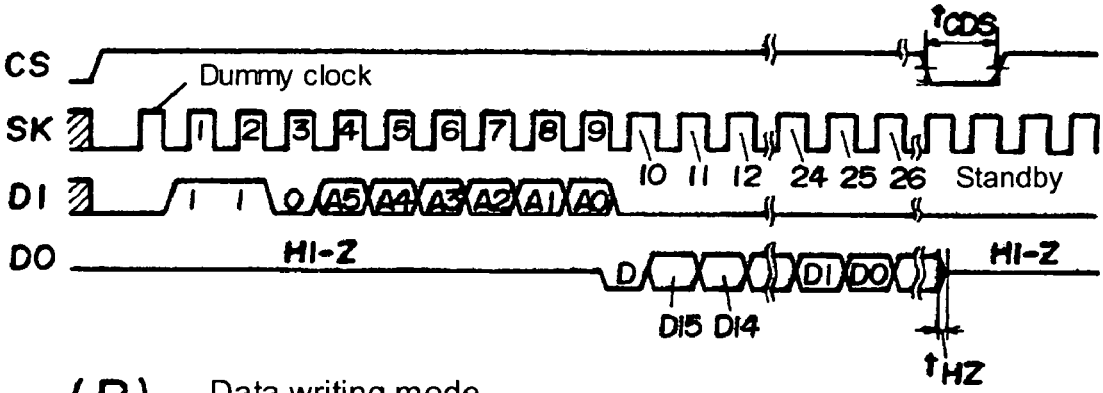
FIG. 12 is a timing chart of the reading mode, writing mode, or erasing mode.
Figure 12:
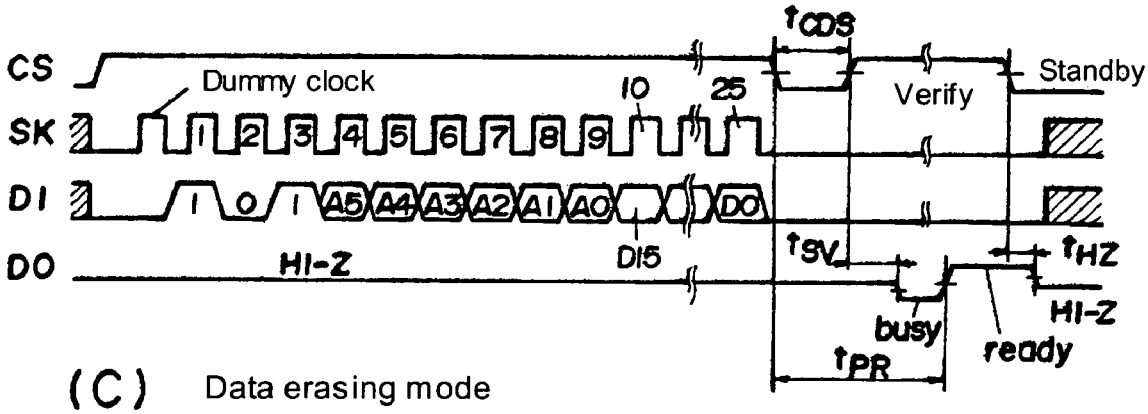
Figure 12:
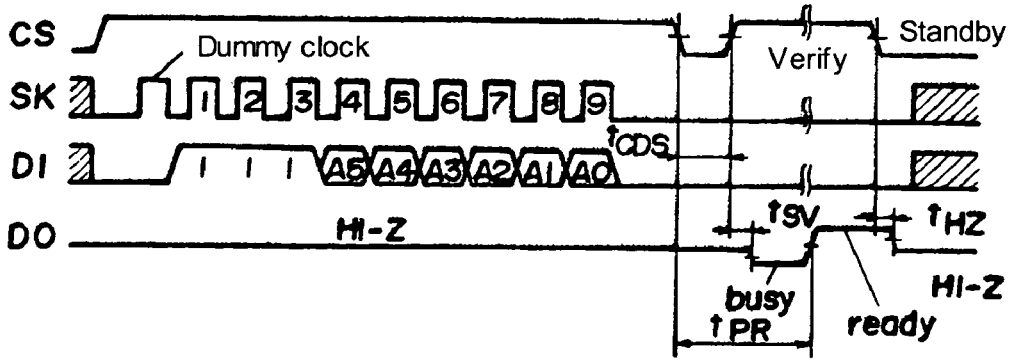

Here, data reading and writing operations of the nonvolatile memory 120 (EEPROM) will be described using FIG. 11 and FIG. 12. FIG. 11 is an illustration showing operation codes of the nonvolatile memory 120. In addition, FIG. 12 is timing charts of three modes (data reading, data writing, data erasing).

Here, symbols respectively show the following: CS: chip select, SK: clock, DI: operation code, address input, and DO: data output.

As the operation code and address are sent to DI terminal in synchronization with clock starting, they are read therefrom. Data is output to DO terminal in synchronization with the clock starting. Seven modes can be implemented by combining the operation codes and addresses.

Here the manufacturing stages of the process cartridges 1 will be described. Since the photosensitive drums have fluctuations in sensitivity, a correction value is to be measured for individual process cartridges 1. The measured corrected values are the process conditions 1, 2.

In addition, for the counter value, "0" must be written according to the timing chart shown in FIG. 12, as data in a nonvolatile memory. As a result, the nonvolatile memory 120 before shipment of the process cartridges 1 is set as follows: a serial number (sequentially, starting from 1) in addresses 0 to 1, a counter value (0) to address 2, process condition 1 in address 3 (−10 to 10), process condition 2 (−63 to 63) in address 4 as data.

Figure 13:
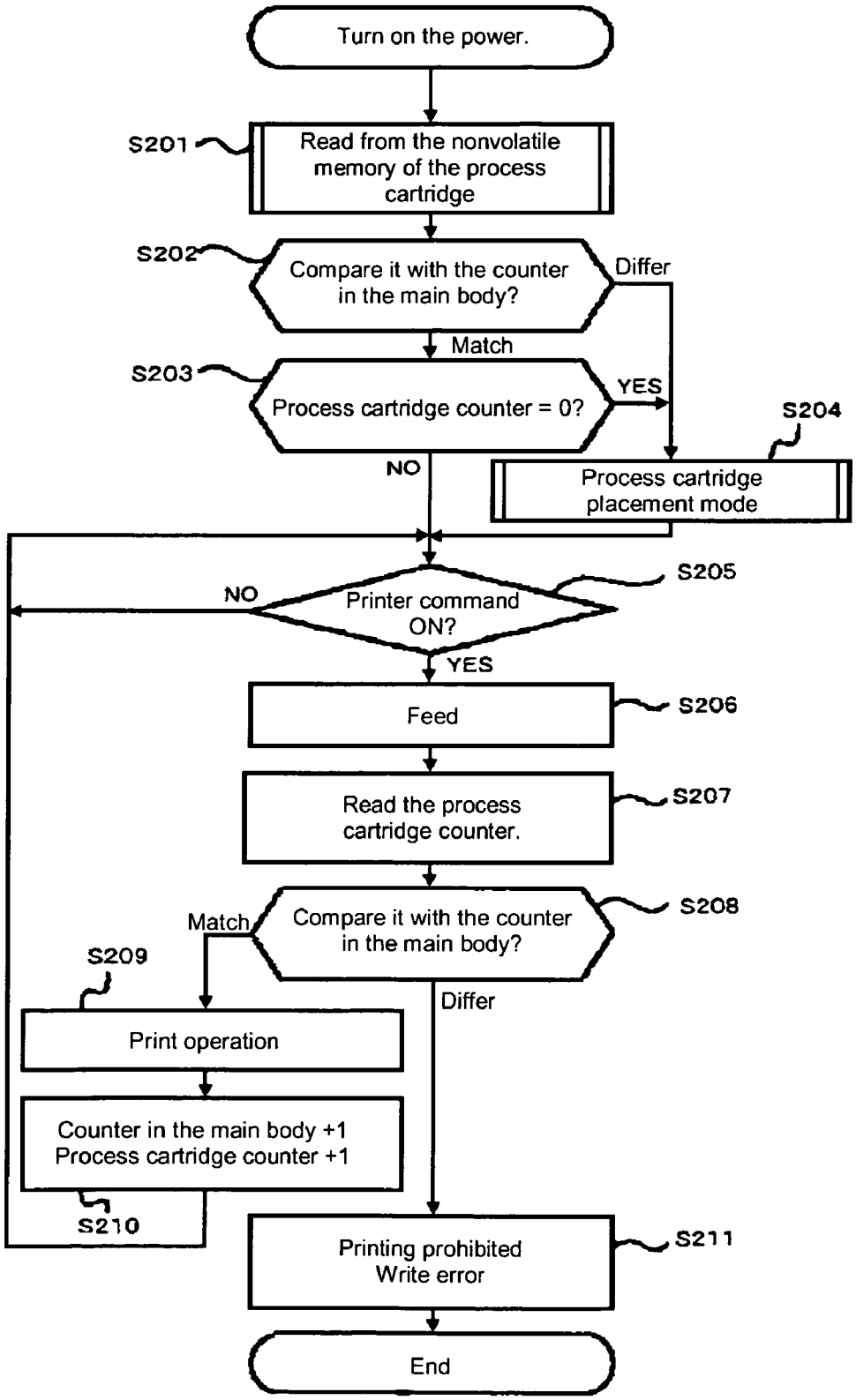
FIG. 13 is a flow chart showing a routine for printing process.

In the following, print operation with reference to FIG. 13 to FIG. 15 will be described. FIG. 13 is a flow chart showing a print process routine.

When the process cartridge 1 is newly installed in the main body and power is turned on, the main body first reads the nonvolatile memory 121 in the process cartridge 1 (S201).

Figure 14:
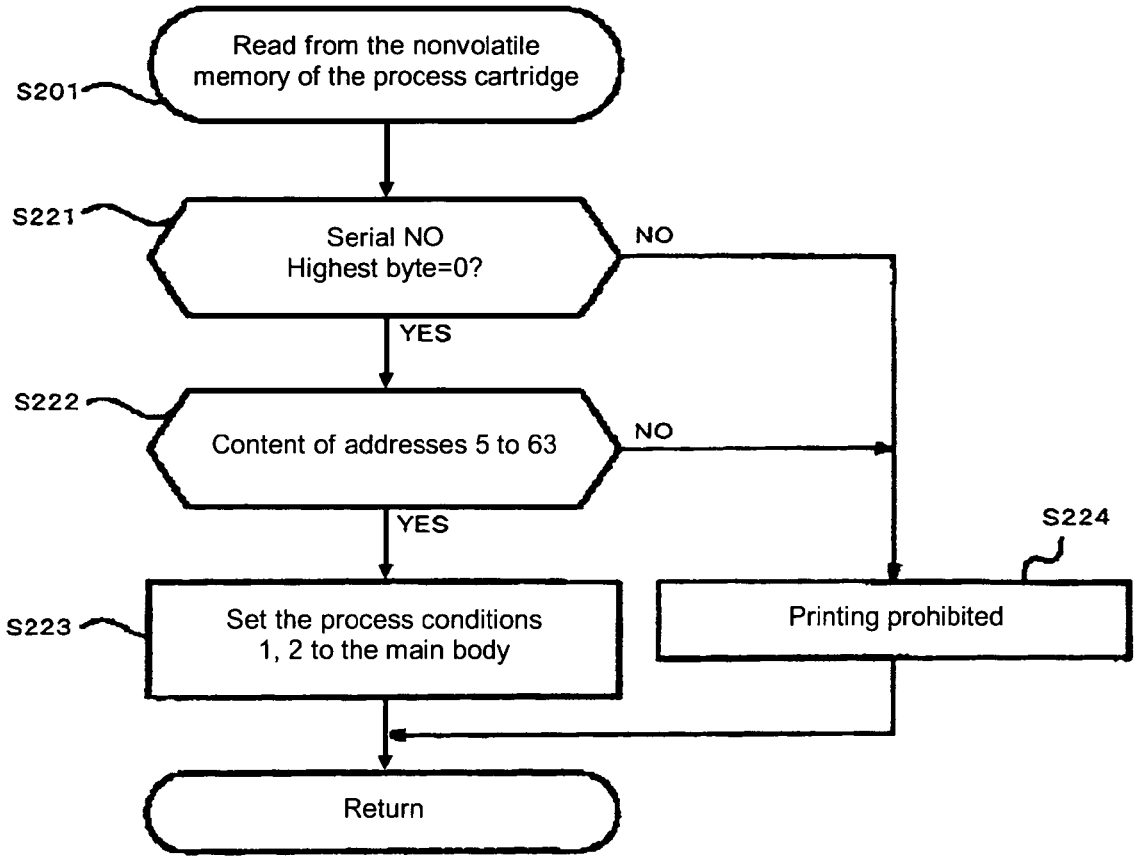
FIG. 14 is a flow chart showing a subroutine for reading process of the memory of the RFID tag.

FIG. 14 is a flow chart showing a reading subroutine of the nonvolatile memory 121. The subroutine checks whether the highest byte in the addresses 0 to 1 is equal to "0" (Step S221).

Here, when the highest byte of the serial number in addresses 0 to 1 is equal to "0", checks are carried out if the contents of the addresses 5 to 63 (unused addresses) are "FFH" (step s222).

When the contents of the addresses 5 to 63 are "FFH", the process conditions 1, 2 in the nonvolatile memory 120 are placed in SLAM 102 (step S223), the process returns to the main routine as shown in FIG. 13.

On the other hand, in the subroutine shown in FIG. 14 (steps S221 and S222), if the serial number or the unused addresses differ, printing is prohibited (step S224). This is because a determination was made that the nonvolatile memory 121 was rewritten and tampered.

After reading of the nonvolatile memory 120 ends in the step S201 as shown in FIG. 13, the counter in the main body stored in SRAM 102 of the main body is compared with a nonvolatile memory counter (called as a drum counter) with the main body (steps S202, S203). Here, when each of them is same or not 0, the process enters into a print command standby state (Step S205).

In steps S202 and S203 as shown in FIG. 13, the process shifts to the process cartridge installation mode if any one of them differs (Step S204). FIG. 15 is a flow chart showing a subroutine in the process cartridge placement mode.

Figure 15:
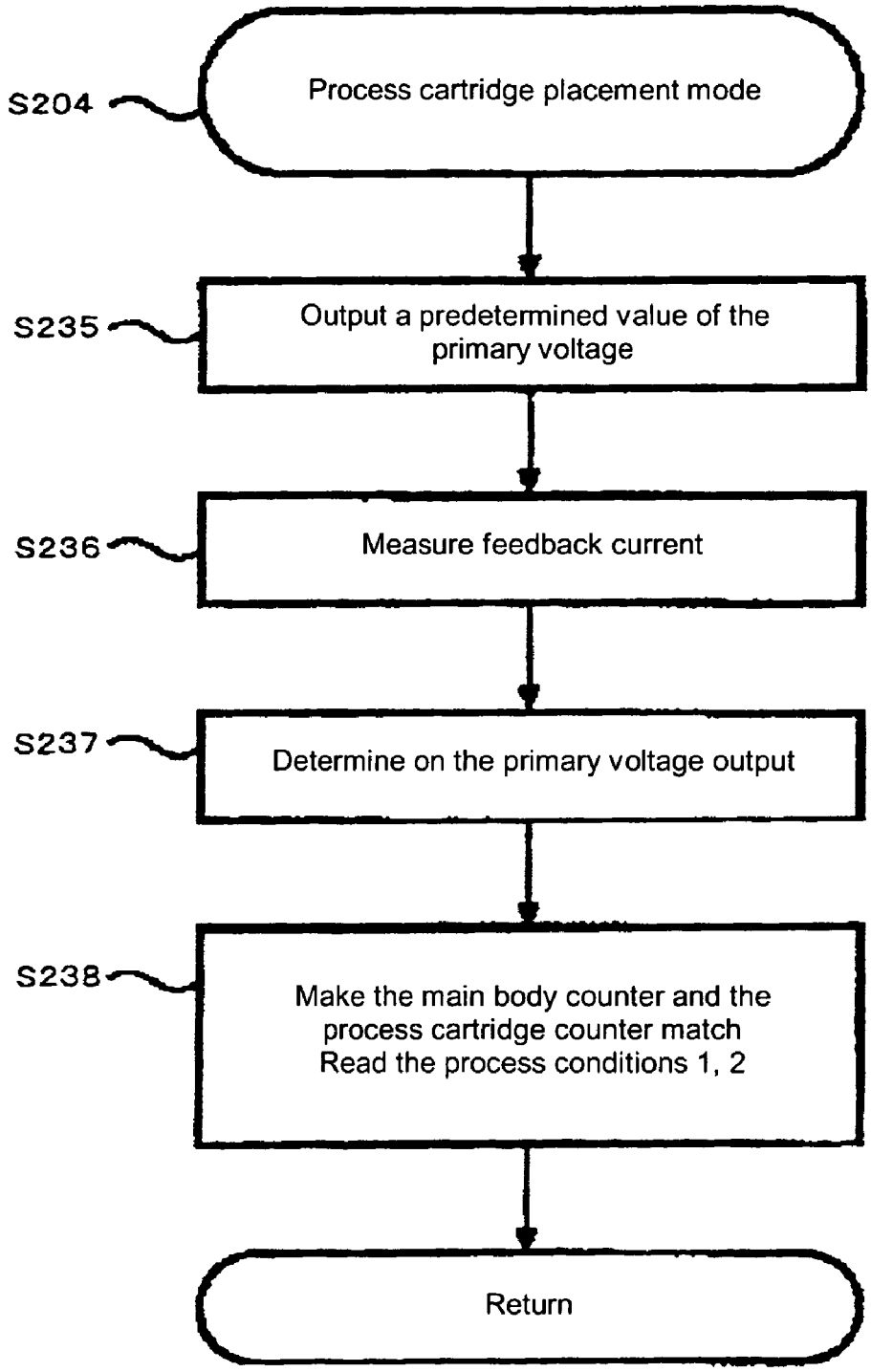
FIG. 15 is a flow chart showing a subroutine of the process cartridge placement mode.

In the process cartridge placement mode as shown in FIG. 15, predetermined primary voltage is output (Step S235), a current value from the photosensitive drum 101 is measured (Step S236), and the primary output voltage at the process cartridge 1 is determined (Step S237).

In addition, not only the counter in the main body is made equal to a value of the drum counter, but also the process conditions 1, 2 written to the nonvolatile memory 12 are read (Step S238), then the subroutine ends and returns to the main routine as shown in FIG. 13.

When the print command is turned on at Step S205 as shown in FIG. 13, recording materials P are fed (Step S206), the drum counter is read (Step S207) and compared with the main body counter (Step S208).

If the drum counter matches the main body counter in Step S208, the print operation is executed (Step S209), the main body counter and the drum counter are incremented by 1 (Step S210), and the subroutine returns to the processing of step S205.

On the one hand, if the drum counter does not match the main body counter in Step S208, printing is prohibited as a writing error of the process cartridge 1 (Step S211).

Thus, use of the RFID tags in the respective process cartridges and the reader/writer on the side of the apparatus main body could facilitate automation of the task of reading characteristic differences due to manufacturing fluctuations in the photosensitive drums, etc., of the process cartridges, or understanding of the total number of prints of the process cartridges.

Second Embodiment

Here, using FIG. 16 and FIG. 17, a second embodiment of the present invention will be described. The present embodiment differs from the first embodiment described above in that the RFID tags and the reader/writer, and the shielded area made by the shield member in which they are arranged are placed in front of the apparatus main body. Thus, only the characteristic part is described, and skip other parts as they are similar to the first embodiment described above.

Figure 16:
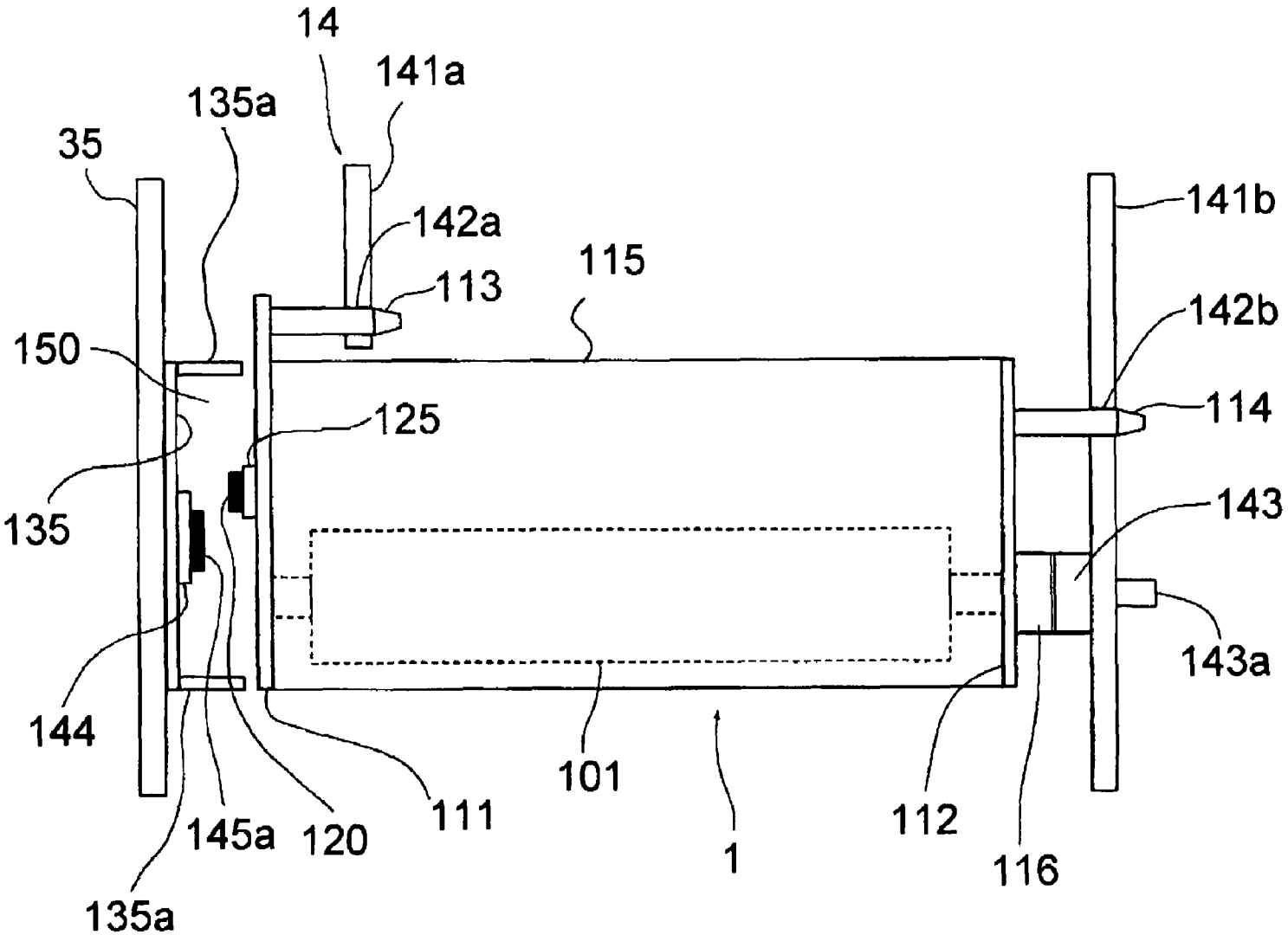
FIG. 16 is a side sectional view showing the process cartridge according to the second embodiment that is completely loaded into the printer main body and the cover is closed.

FIG. 16 is a side sectional view showing the process cartridge 1 loaded into the apparatus main body, being equivalent to FIG. 6 in the first embodiment.

As shown in FIG. 16, on the resin container 115 of the process cartridge 1 according to the present embodiment is provided a base 125 that protrudes more forward than the unit front side plate 111. Then, on the base 125 is arranged the RFID tag as an IC tag.

On the one hand, the front cover 35 of the apparatus main body is provided with the shield plate 135 as a metal grounded shield member. The resin base 144 is provided on the shield plate 135, and the antenna part 145*a* of the reader/writer 145 is arranged on the base 144, thus achieving electromagnetic coupling with the RFID tags 120.

In addition, said unit front side plate 111 is made of metal and well grounded, thus acting as a shield member for shielding electromagnetic radiation noise together with said shield plate 135.

Figure 17:
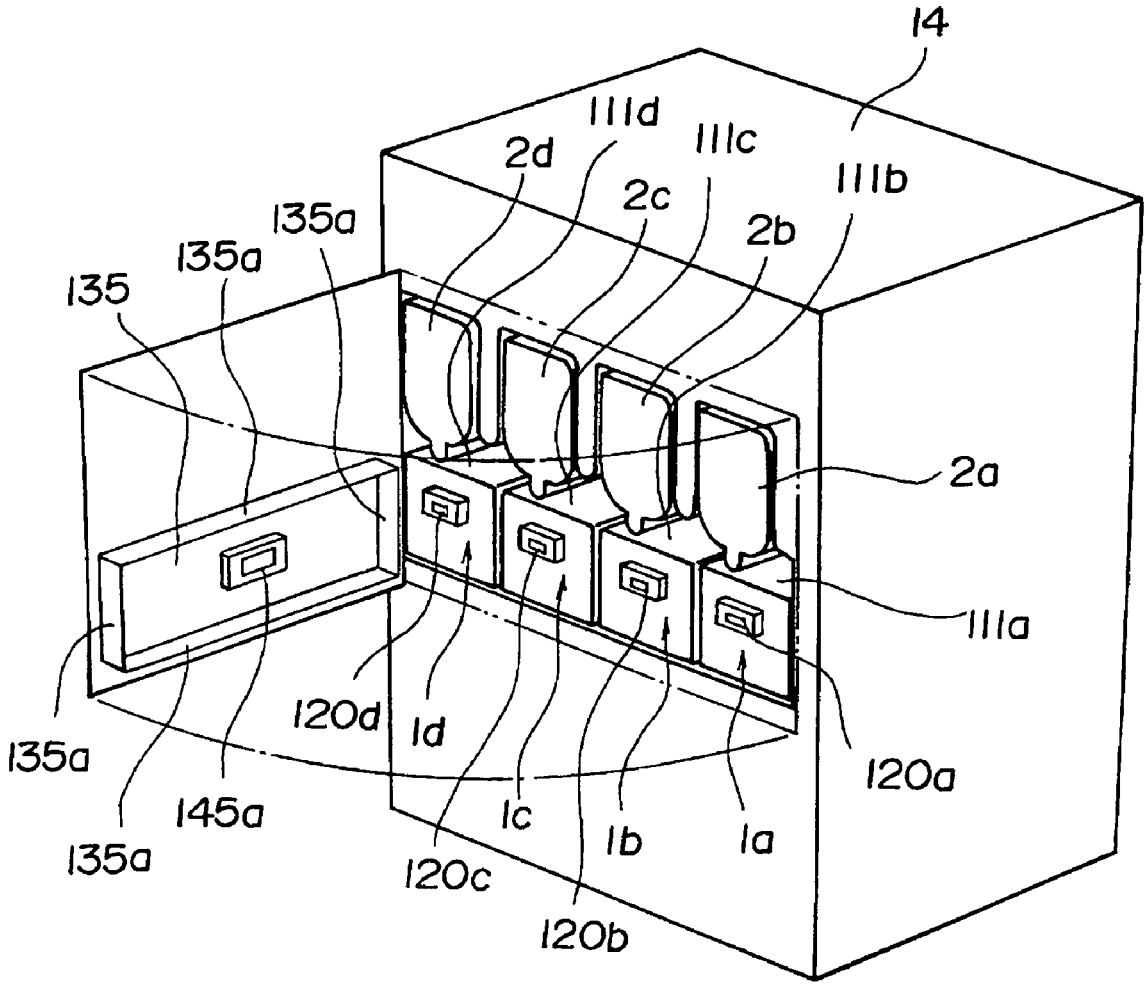
FIG. 17 is a schematic perspective view showing the electrophotographic color printer according to the second embodiment with the openable/closable cover on the front side in opened state.

FIG. 17 is a schematic perspective view showing the process cartridges 1*a*, 1*b*, 1*c*, id being loaded into the apparatus main body 14 and the front cover 35 being in opened state.

As shown in FIG. 17, the shield plate 135 has the side walls 35*a* formed so as to surround 4 sides of the RFID tags 120 that intermediate between the shield plate 135 and the unit side plates 111 of the respective process cartridges, and the antenna part 145*a* of the reader/writer 145. Then, when the process cartridges 1*a*, 1*b*, 1*c*, 1*d* are loaded into the apparatus main body 14 and the front cover 35 is closed, a shielded area 150 as shown in FIG. 16 is defined. In this condition, any gap to be generated between the mutually neighboring parts of the unit front side plates 111*a*, 111*b*, 111*c*, 111*d* of the respective process cartridges 1*a*, 1*b*, 1*c*, id, and the side walls 135*a* of said respective unit front side plates 111 and said shield plate 35 will be minimal.

As described above, with the front cover 35 closed, the RFID tags 120*a*, 120*b*, 120*c*, 120*d* of the respective process cartridges and the antenna part 145*a* of the reader/writer 145 are arranged within the shielded area 150. Therefore, communication between the RFID tags 120 and the antenna part 145*a* of the reader/writer 145 takes place within the shielded area consisted of the unit front side plate 111 functioning as a shield member, and the shield plate 135 that the cover 13 has. Thus, even in the present embodiment, similar to the first embodiment described above, electromagnetic radiation noise during communication can be shielded by the shield effect and electromagnetic radiation noise leaking to the outside of the apparatus main body is substantially reduced.

Third Embodiment

Here, using FIG. 18 and FIG. 19, a third embodiment of the present invention will be described. This embodiment differs from the first embodiment described above in that the RFID tags are arranged in positioning pins of the process cartridge. Thus, only the characteristic part is described, and skip other parts as they are similar to the first embodiment described above.

Figure 18:
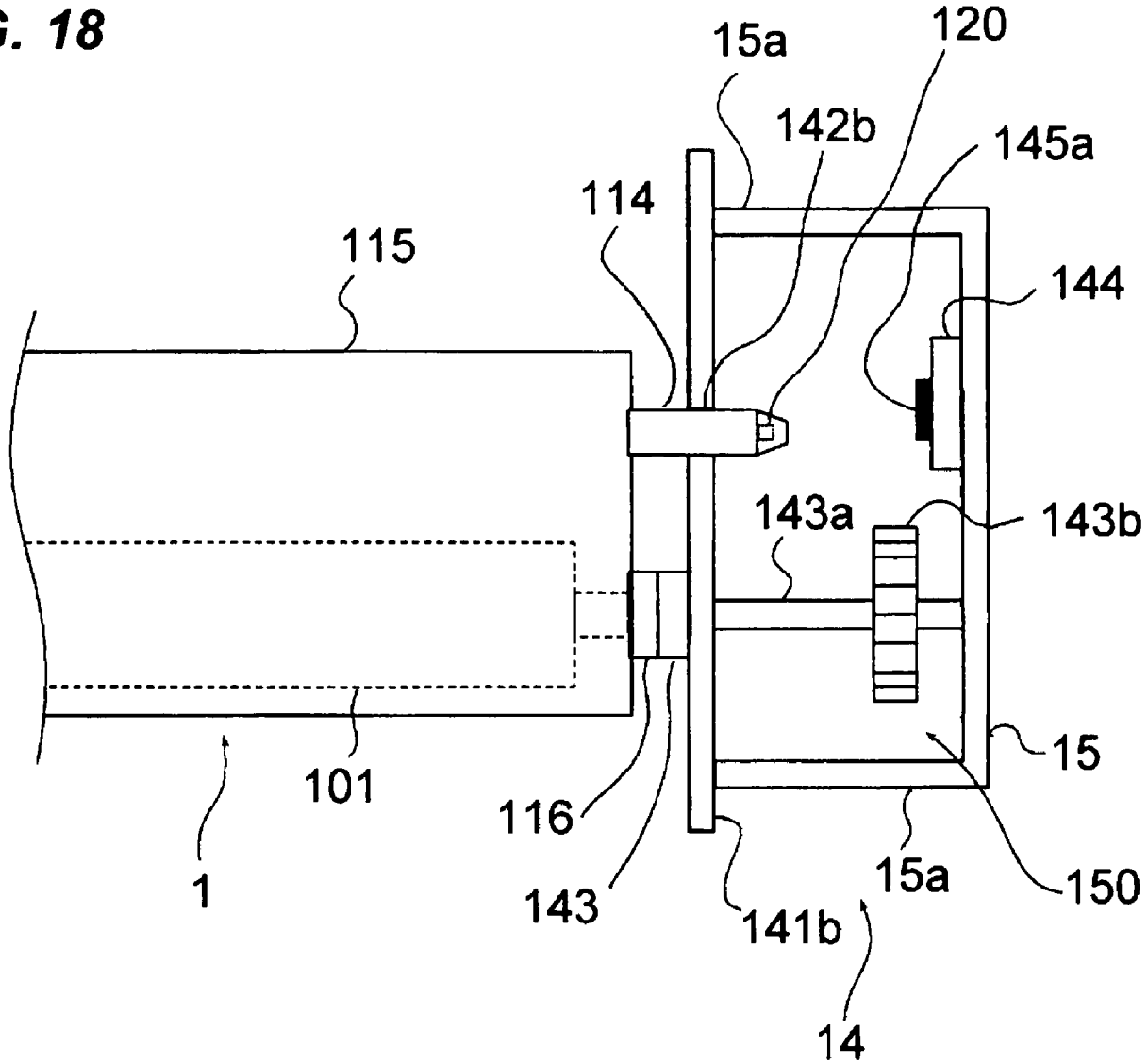
FIG. 18 is a side sectional view of the main component showing the process cartridge according to the third embodiment being completely loaded into the printer main body.

FIG. 18 is a side sectional view of the main components showing the process cartridge 1 loaded into the apparatus main body 14.

As shown in FIG. 18, in the present embodiment, the positioning pin 114 is defined by projecting a part of the resin container 115 of the process cartridge 1. Then, at the top end of the positioning pin 114 the RFID tag as an IC tag is integrally molded.

Figure 19:
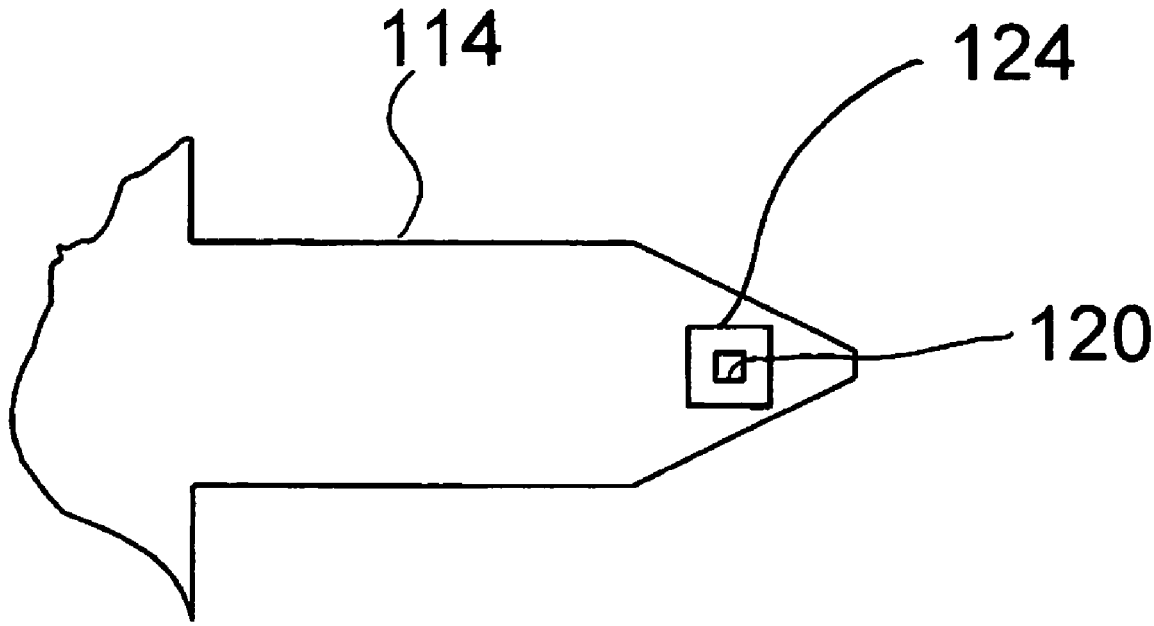
FIG. 19 is an enlarged view of a chief part in the proximity of the RFID tag of the third embodiment.

FIG. 19 shows detailed sectional view of the positioning pin unit at the process cartridge.

As shown in FIG. 19, the RFID tag 120 is contained in a capsule 124 of thermal insulator. This is to protect the RFID tag easily affected by heat against high temperatures during resin molding. The RFID tag in the present embodiment is a further miniaturized tag of the first embodiment described above.

The positioning pin 114 fits into the positioning hole 142*b* of the main body back side plate 141*b*, and then projects more than the main body back side plate 141*b*. Thus, the RFID tag 120 located on the top end of the positioning pin 114 could be arranged at a position away from the main body back side plate 141*b* made of metal. This could eliminate possible communication fault attributable to presence of a metal member existing close to the RFID tag 120.

The process cartridge 1 is driven by the drive source through a gear integrally connected with the coupling 143 for driving internal members (photosensitive drums or development apparatuses).

Said coupling 143*a* and gear 143*b* are connected at a drive shaft 143*a*, the drive shaft 143 being rotatably axially supported by the main body back side plate 141*b* and a metal drive box 15. The drive box 15 axially supports a gear train, a timing belt, a drive source as a drive transmission member for driving other units such as the toner cartridge in addition to the process cartridges, and defines the shielded area 150 as shown in FIG. 18 together with the main body back side plate 141*b*.

As the unit back side plate 112 and the drive box 15 that define the shielded area 150 are made of metal and sufficiently grounded, they function as a shield member for shielding electromagnetic radiation noise.

The resin base 144 is provided inside the drive box 15, and the antenna part 145*a* of the reader/writer 145 is arranged on the base 144, thus achieving electromagnetic coupling with the RFID tag 120.

With this configuration, when the process cartridges are loaded into the apparatus main body, RF tags of the respective process cartridges are arranged in the shielded area 150 where the antenna part 145*a* of the reader/writer 145 is provided. Therefore, communication between the RFID tags 120 and the antenna part 145*a* of the reader/writer 145 takes place within the shielded area consisted of the unit back side plate 112 functioning as a shield member, and the drive box 115.

Thus, even in the present embodiment, similar to the first and second embodiments described above, electromagnetic radiation noise during communication can be shielded by the shield effect and electromagnetic radiation noise leaking to the outside of the apparatus main body is substantially reduced.

Furthermore, the RFID tags 120 are built-in in the positioning pins 114 of the process cartridges, which eliminate the need for providing the base for arranging the RFID tags 120 on the process cartridges, and thus enabling simplification of the shape and space-saving of the container 115.

In addition, since the RFID tags 120 are provided inside the top ends of the positioning pins 114, and not exposed to the surface of the process cartridges, the RFID tags are not in danger of contacting other members and being damaged while they are physically distributed or replaced.

Other Embodiments

Although process cartridges or toner cartridges are exemplified, as a replacement unit that can be detachably loaded into an image forming apparatus main body in the embodiments described above, this invention shall not be limited to this. Said replacement unit may take some other configuration if it is a cartridge having at least one of an image bearing member, a development apparatus for forming images by means of a developer on said image bearing member, and a developer refilling device for refilling the developer into said development apparatus. In addition, although the case there are 4 process cartridges or toner cartridges that can be detachably loaded into the image forming apparatus main body is exemplified, the number of the cartridges to be used shall not be limited to the number described above, but may be set appropriately, as necessary. In addition, although the configuration that has one reader/writer for communicating to the 4 IC tags is exemplified in non-contact manner, the configuration shall not be limited to this, and, for example, the configuration that has one reader/writer for every 2 IC tags, or that has one reader/writer for each one of many IC tags for the process cartridges or many IC tags for the toner cartridges may be set appropriately, as necessary.

In addition, in the third embodiment described above, although the configuration wherein the RFID tag 120 is provided at the top end of the positioning pin 114 located in the back side of the process cartridge loading direction is exemplified, and the main body back side plate 141*b* that positions and supports the process cartridge and the drive box 15 having the gear train, etc., function as a shield member and define the shielded area 150, the present invention shall not be limited to this. For instance, the configuration may be such that the IC tag is provided at the top end of the positioning pin in the front of the process cartridge loading direction, and the main body front side plate that positions and supports the process cartridge and the shield member (such as a metal grounded shield plate) that provides the reader/writer on the main body front side plate are mounted so as to define the shielded area, which may achieve the similar effect.

In addition, in the embodiments described above, although the process cartridges that integrally have the photosensitive drums are exemplified, the charging device as the process means that acts on the photosensitive drums, the development means, and the cleaning means, as the process cartridge that can be detachably loaded into the image forming apparatus main body, the process cartridges shall not be limited to them, and may be process cartridges that integrally have any one of the charging device, the development means, or the cleaning means, in addition to the photosensitive drums.

In addition, although the printer as an image forming apparatus in the embodiments described above is exemplified, the present invention shall not be limited to this, and may be any other image forming apparatus such as a copying machine, facsimile device, etc., or other image forming apparatus such as a complex machine that combines these functions. Or, it may be an image forming apparatus that uses a recording material bearing member and serially transfers toner images of respective colors on the recording materials borne by the recording material bearing member, which can achieve similar effect by applying the present invention to the image forming apparatus described above into which a replacement unit can be detachably loaded.

This application claims the benefit of priority from the prior Japanese Patent Application No. 2005-108397 filed on Apr. 5, 2005 the entire contents of which are mounted herein by reference.

What is claimed is:

1. An image forming apparatus comprising:

a main body:

a replacement unit having an IC tag that performs data writing or reading through non-contact wireless communication;

at least one reader/writer having an antenna part that writes or reads data to/from the IC tag of said replacement unit through non-contact wireless communication; and a shield member defining a shielded area for blocking electromagnetic radiation noise, wherein at least the IC tag and the antenna part of said reader/writer are arranged in said shielded area, wherein said shield member has a positioning hole for positioning the replacement unit on said main body, and wherein said replacement unit has a positioning protrusion that passes through said positioning hole and provides said IC tag at an end of said positioning protrusion.

2. The image forming apparatus according to claim 1, wherein said main body includes a main body side plate, which has said positioning hole, supporting said replacement unit, and a drive box attached to said main body side plate, said drive box having a drive transmission member for transmitting driving force to said replacement unit, and wherein said main body side plate and said drive box function as said shield member.

3. The image forming apparatus according to claim 1, further including at least an image bearing member, a development apparatus for forming images by a developer on said image bearing member, and a developer refilling device for refilling the developer to said development apparatus, wherein said replacement unit has at least one of said image bearing member, said development apparatus, or said developer refilling device.

4. An image forming apparatus comprising:

a main body;

a replacement unit having an IC tag that performs wireless communication;

a wireless communication device that performs wireless communication with the IC tag;

a shield member that defines a shielded area for blocking electromagnetic radiation noise;

a positioning holes for positioning the replacement unit on the main body; and a positioning projection provided in the replacement unit and configured to pass through the positioning hole, wherein the IC tag is provided in the positioning projection, and wherein the wireless communication device performs wireless communication with the IC tag within the shielded area.

5. The image forming apparatus according to claim 4, wherein said main body has a main body side plate, which has said positioning hole, supporting said replacement unit, and a drive box attached to said main body side plate, said drive box having a drive transmission member for transmitting driving force to said replacement unit, and wherein said main body side plate and said drive box function as said shield member.

6. The image forming apparatus according to claim 4, further including at least an image bearing member, a development apparatus for forming images by a developer on said image bearing member, and a developer refilling device for refilling the developer to said development apparatus, wherein said replacement unit has at least one of said image bearing member, said development apparatus, or said developer refilling device.

* * * * *